US006105717A

United States Patent [19]

Kleukers

[11] Patent Number: 6,105,717

[45] Date of Patent: Aug. 22, 2000

[54] PIPE SECTION PUNNING ALONG A CURVE

[75] Inventor: Paulus Henricus Kleukers, Beegden, Netherlands

[73] Assignee: Arvin Exhaust B.V., AE Roermond, Netherlands

[21] Appl. No.: 09/239,681

[22] Filed: Jan. 29, 1999

[30] Foreign Application Priority Data

Feb. 9, 1998 [NL] Netherlands ..... 1008252

[51] Int. Cl.[7] ..... F01N 7/18

[52] U.S. Cl. ..... 181/282; 181/264; 181/247; 181/241; 181/227

[58] Field of Search ..... 181/282, 264, 181/247, 241, 227

[56] References Cited

U.S. PATENT DOCUMENTS

| | | | |
|---|---|---|---|
| 3,645,357 | 2/1972 | Cassel | 181/36 B |
| 3,648,802 | 3/1972 | Pierce | 181/44 |
| 4,396,090 | 8/1983 | Wolfhugel . | |
| 4,671,381 | 6/1987 | Rascov | 181/255 |
| 5,332,873 | 7/1994 | Kullander et al. . | |
| 5,581,056 | 12/1996 | Beligardt et al. | 181/282 |

FOREIGN PATENT DOCUMENTS

| | | | |
|---|---|---|---|
| 0 556 262 | 8/1993 | European Pat. Off. . | |
| 2599082 | 5/1987 | France | F01N 1/08 |
| 2 502 693 | 10/1992 | France . | |
| 94 00 796 | 4/1994 | Germany . | |
| 195 34 841 | 3/1996 | Germany . | |

*Primary Examiner*—Bentsu Ro
*Assistant Examiner*—Edgardo San Martin
*Attorney, Agent, or Firm*—Young & Thompson

[57] ABSTRACT

Pipe section running along a curve, intended for use in a muffler, comprising two hollow-formed molded parts which are mirror-symmetrical in relation to the radial plane of the curve and which have connected thereto a flat outside edge running in the radial plane along the outside of the curve, which flat outside edges are placed on each other so that the molded parts together form the pipe section, a third flat part being placed at the position of the radial plane between the two molded parts in such a way that a curved edge of said third flat part is situated between the two flat outside edges of the molded parts and is fastened to said outside edges.

7 Claims, 2 Drawing Sheets

PIPE SECTION PUNNING ALONG A CURVE

BACKGROUND OF THE INVENTION

The invention relates to a pipe section running along a curve, intended for use in a muffler, comprising two hollow-formed moulded parts which are mirror-symmetrical in relation to the radial plane of the curve and which have connected thereto a flat outside edge running in the radial plane along the outside of the curve, which flat outside edges are placed on each other so that the moulded parts together form the pipe section.

Such pipe sections are known per se. A practical embodiment can be seen in FIG. 2 of FR-2,599,082. In this case the hollow space inside the mirror-symmetrical hollow-formed moulded parts is shut off by a flat sheet situated at right angles to the radial plane and having two round apertures in which the connecting pipe sections can be fitted.

Another practical embodiment is shown in FIG. 2 of U.S. Pat. No. 5,332,873. In the case of this embodiment, each of the moulded parts is provided with a flat inside edge running in the radial plane along the inside of the curve. Both the inside edges and the outside edges are fastened to each other, with the advantage that the hollow-formed moulded parts form two round apertures on the ends of the pipe section, in which apertures directly connecting pipe sections can be fitted.

In the field of mufflers there are constant efforts to raise overall sound absorption to the highest possible level. On the one hand, ever-increasing standards are being set for mufflers, on account of environmental considerations, while, on the other hand, many car owners also find a "quiet" car very comfortable.

SUMMARY OF THE INVENTION

The object of the invention is therefore to design the pipe section running along a curve in such a way that greater sound absorption can be achieved by it.

This object is achieved in the case of a pipe section of the type mentioned in the preamble by the fact that a third flat part is placed at the position of the radial plane between the two moulded parts in such a way that a curved edge of said third flat part is situated between the two flat outside edges of the moulded parts and is fastened to said outside edges.

In a curved pipe section whirls will generally occur, in particular in the outside bend, because the air flow has to change direction. These whirls lead to undesirable noise generation. These whirls are considerably reduced by now placing a third face inside the pipe section in accordance with the invention, with the result that said pipe section is in fact divided into two half pipe sections, one situated above the other. In particular, the flow noise is significantly reduced by this measure.

The invention can also be used in the case of a pipe section running according to a curve in which each of the moulded parts is provided with a flat inside edge running in the radial plane along the inside of the curve. In that case the third flat part is not only clamped and fastened between the outside edges, but is also clamped and fastened between the inside edges.

Although perforated sheet is commonly used in sound absorber constructions, it is preferable in connection with the invention for the third flat sheet to be formed from non-perforated sheet.

The invention can be used in the case of pipe sections running through a different curve angle. In the case of smaller angles of curvature, in which fewer whirls are created, the effect of the invention will generally be less than is the case with larger angles of curvature. In general, it will therefore be preferable, both from the point of view of sound reduction and also for construction reasons, for the curve to run through approximately 180°.

A further, albeit much less significant sound reduction can be achieved if the third flat part is designed in such a way that part of it runs on into one of the further pipes connecting to the pipe section.

In the case of S-shaped pipe sections, such as described, for example, in the already mentioned U.S. Pat. No. 5,332,873, it is preferable for the third parts in each of the two pipe sections to connect to each other and be formed from a single flat sheet.

BRIEF DESCRIPTION OF THE DRAWINGS

The invention will be explained in greater detail below with reference to the appended figures.

DETAILED DESCRIPTION OF THE INVENTION

Figure 1A:
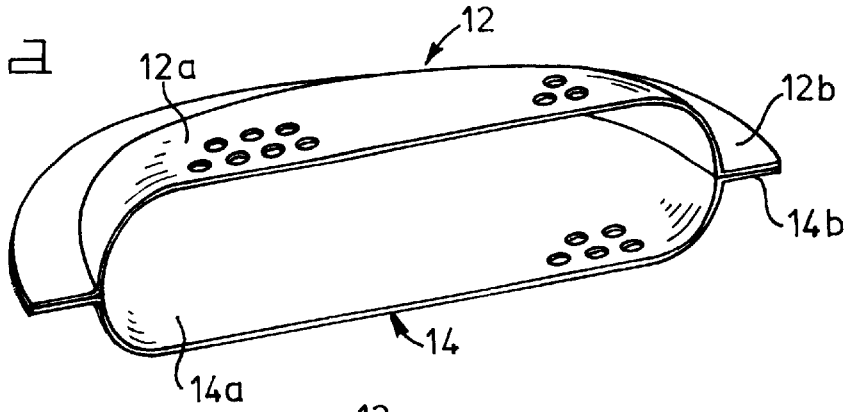
fig-1a PRIOR ART
FIG. 1*a* shows a prior art example of a curved pipe section.

FIG. 1*a* shows a pipe section running along a curve, of the type illustrated in FIG. 2 of FR-2,599,082. The pipe section 10 is composed of two mirror-symmetrical parts 12 and 14, each provided with a central hollow part 12*a*, 14*a* respectively, and flat edge parts 12*b* and 14*b* respectively connecting thereto. In the fitted state the edge parts 12*b* and 14*b* rest one upon the other and are fastened to each other by, for example, spot welding. In this state the edge parts lie in the radial plane of the bend. The hollow parts 12*a* and 14*a* run above and below this radial plane respectively.

The bend is in fact completed by placing a front face 18 at right angles to the radial plane, which front face 18 is provided with two round apertures in which two connecting pipes can be placed. This will be explained in further detail with reference to FIG. 1*c*.

Figure 1B:
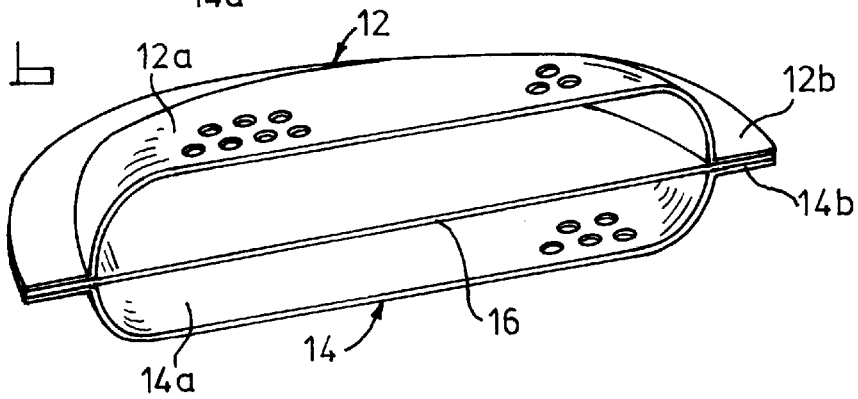
FIGS. 1*b* and 1*c* show two embodiments of a bend of a first type.
Figure 1C:
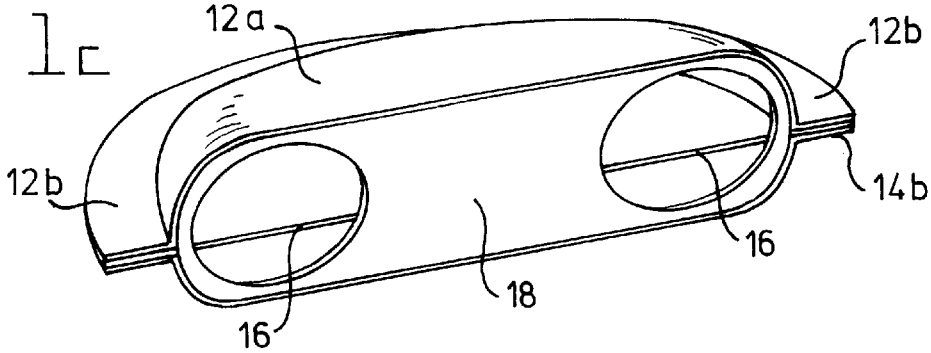

In accordance with the invention, before the edges 12*b* and 14*b* are welded to each other, a flat sheet 16 is pushed between the two parts 12 and 14. The periphery of said sheet 16 is of such a shape that the sheet fits between the edges 12*b* and 14*b*, as shown in FIG. 1*b*. After these three parts have been placed on top of one another, the edges 12*b* and 14*b*, with the edge of the sheet 16 between them, are fastened to each other again, for example by welding or soldering. Thereafter, the front plate 18 is fastened in a manner which will not be described in any further detail, and further pipes of the sound absorber system can be fitted in the two apertures of the front plate 18.

Figure 1D:
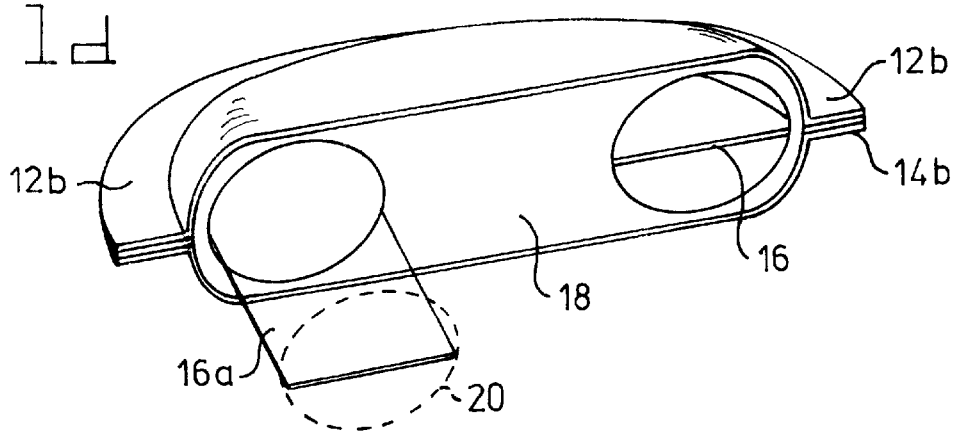
FIG. 1*d* shows an additional embodiment of a bend of a first type.

FIG. 1*d* indicates that according to a special embodiment of the invention the sheet 16 can also be formed in such a way that it extends over a certain distance into one of the two pipes connected to the front plate 18. In particular, in FIG. 1*d* the pipe 20 is indicated by a dashed line and it can be seen that the sheet 16 has a part 16*a* projecting out of the bend, which part is situated in the pipe 20 and in fact divides said pipe lengthwise into two sections.

Figure 2A:
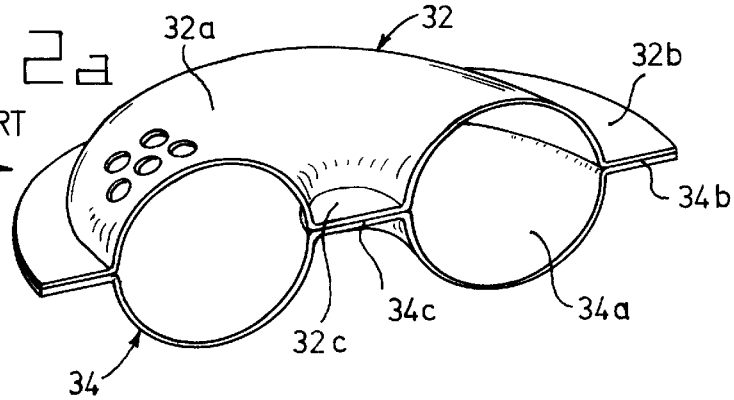
Fig-2a PRIOR ART
FIG. 2*a* shows another prior art example of a curved pipe section.

Another embodiment, based on a bend of the type shown in U.S. Pat. No. 5,332,873, is illustrated in FIG. 2. FIG. 2*a* shows the pipe section 30 running along a curve and essentially composed of only two parts 32 and 34. Both parts 32 and 34 have, on the one hand, a flat outside edge 32*b* and 34*b* respectively running along the outside curve and, on the other hand, a flat inside edge 32*c* and 34*c* respectively running along the inside curve. In the fitted state these edge parts fit on top of one another and are fastened to each other in a suitable manner. In addition, each part contains a hollow moulded part 32*a* and 34*a* respectively. The shape of these moulded parts is selected in such a way that in the fitted state both moulded parts together form a pipe section running along a curve, in the manner illustrated in FIG. 2*a*.

An advantage of the embodiment according to FIG. 2*a* over that of FIG. 1*a* may be the fact that in this embodiment no additional front plate (such as 18 in FIG. 1*c*) is necessary for the connection of further pipes thereto. The moulded parts themselves directly define two round apertures to which pipes can be connected.

Figure 2B:
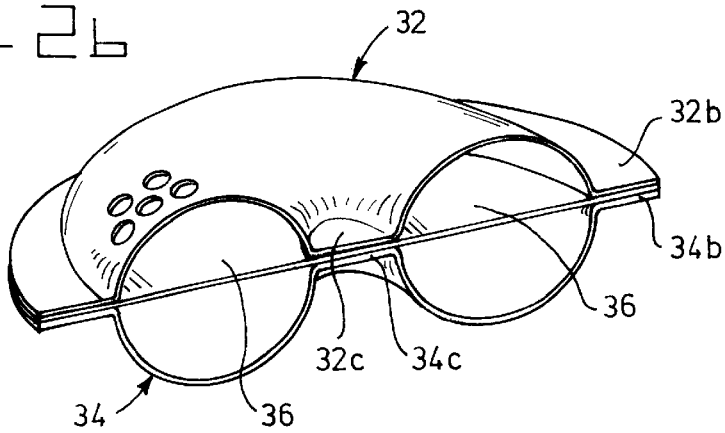
FIG. 2*b* shows an embodiment of a bend of a second type.

In accordance with the invention, the pipe section according to FIG. 2*a* is now extended by a third part 36 composed of a flat sheet which is shaped in such a way that it fits between the two parts 32 and 34. When the three parts are stacked on top of one another, the round edge of the sheet 36 will then fit between the outside edges 32*b* and 34*b*, while a part of the front side of the sheet 36 fits between the inside edges 32*c* and 34*c*, all this as shown in FIG. 2*b*.

Figure 2C:
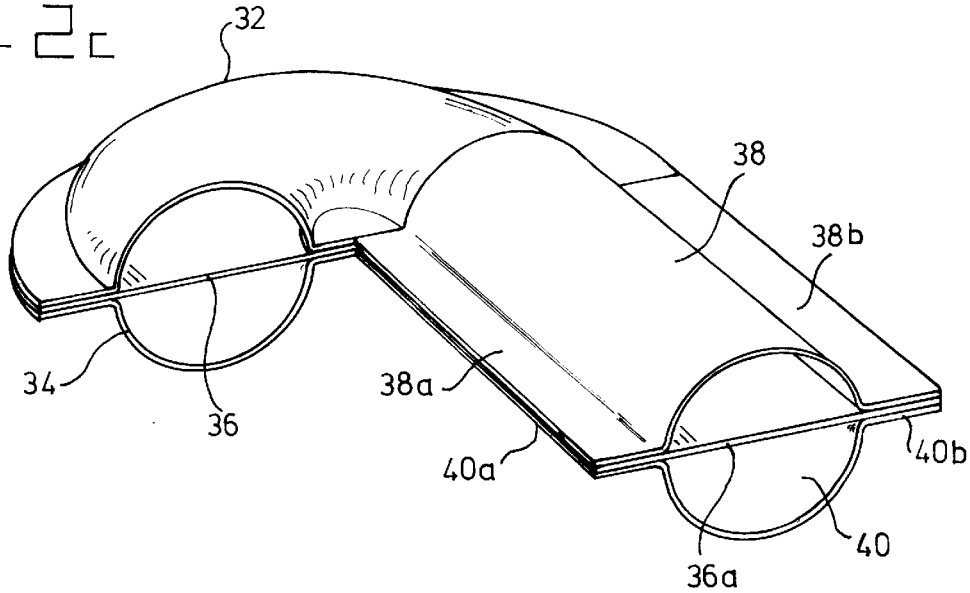
FIG. 2*c* shows an additional embodiment of a bend of a second type.

FIG. 2*c* shows a further development of this pipe section, in the case of which the flat sheet 36 runs on into at least one of the connected straight pipes. In FIG. 2*c* it is assumed that said straight pipe has been manufactured in a similar manner to that of the bend part, from two moulded parts 38 and 40, each provided with a hollow central part and connecting edges 38*a*, 38*b*, 40*a*, 40*b*. Easy and quick fitting is achieved by placing the two moulded parts one on top of the other, with the projecting part 36*a* of the sheet 36 between them, and then soldering or welding all edges to each other.

In all embodiments of the invention the added sheet 16 in FIG. 1 and 36 in FIG. 2 is made of a non-perforated flat sheet. The other moulded parts can be made of perforated or non-perforated or partially perforated sheet, depending on the further construction of the sound absorber. The perforation of the moulded parts 14*a* and 32 is indicated diagrammatically in FIGS. 1*a* and 2*a*. In this case the edge parts will preferably not be perforated, in order to make the fitting easier, while—depending on the further construction of the sound absorber—the walls of the hollow moulded parts can be perforated. The use of perforations in these moulded parts is otherwise known from the prior art; see, inter alia, the already mentioned U.S. Pat. No. 5,332,873 and FR-2,599,082.

A significant improvement of the sound absorption is achieved by means of the invention, and this is attributed to a reduction in the air whirls in the outside bend of the curved pipe section. A reduction of the flow noise is achieved by reducing the whirls in the outside bend.

What is claimed is:

1. A pipe section running along a curve, intended for use in a muffler, comprising two hollow-formed moulded parts which are mirror-symmetrical in relation to a radial plane of the curve and which have connected thereto a flat outside edge running in the radial plane along the outside of the curve, said flat outside edges being placed on each other so that the moulded parts together form the pipe section, wherein a third flat part is placed at a position of the radial plane between the two moulded parts in such a way that a curved edge of said third flat part is situated between the two flat outside edges of the moulded parts and is fastened to said outside edges.

2. Pipe section running along a curve according to claim 1, wherein each of the two moulded parts is provided with a flat inside edge running in the radial plane along the inside of the curve, and the inside edges of both moulded parts rest against the third flat part and are each fastened thereto.

3. Pipe section running along a curve according to claim 1, wherein the third flat sheet comprises a non-perforated sheet.

4. Pipe section running along a curve according to claim 1, wherein the curve runs through approximately 180°.

5. Pipe section running along a curve according to claim 1, wherein a part of the third flat part attaches to one of two further pipes connecting to the pipe section.

6. S-shaped pipe section, intended for use in a sound absorber, comprising two pipe sections as claimed in claim 1.

7. S-shaped pipe section according to claim 6, wherein the third flat part of each of the two pipe sections connect to each other and comprise a single flat sheet.

* * * * *

UNITED STATES PATENT AND TRADEMARK OFFICE

CERTIFICATE OF CORRECTION

PATENT NO. : 6,105,717

DATED : August 22, 2000

INVENTOR(S) : Paulus Henricus Kleukers

It is certified that error appears in the above-identified patent and that said Letters Patent is hereby corrected as shown below:

On the title page, change "PUNNING" to --RUNNING--.

Signed and Sealed this

First Day of May, 2001

*Attest:*

Nicholas P. Godici

NICHOLAS P. GODICI

*Attesting Officer*

*Acting Director of the United States Patent and Trademark Office*